US006440652B1

(12) United States Patent
Nishio

(10) Patent No.: US 6,440,652 B1
(45) Date of Patent: Aug. 27, 2002

(54) PROCESSING METHOD OF SILVER HALIDE LIGHT SENSITIVE PHOTOGRAPHIC MATERIAL

(75) Inventor: Shoji Nishio, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/586,498

(22) Filed: Jun. 2, 2000

(30) Foreign Application Priority Data

Jun. 7, 1999 (JP) ..... 11-159278

(51) Int. Cl.[7] ..... G03C 5/31

(52) U.S. Cl. ..... 430/399; 430/440; 430/441; 430/446

(58) Field of Search ..... 430/440, 441, 430/446, 399

(56) References Cited

U.S. PATENT DOCUMENTS

| | | | | |
|---|---|---|---|---|
| 4,828,968 A | | 5/1989 | Okutsu | 430/398 |
| 4,977,067 A | | 12/1990 | Yoshikawa | 430/398 |
| 5,384,232 A | * | 1/1995 | Bishop et al. | 430/483 |
| 5,385,811 A | * | 1/1995 | Hirano | 430/488 |
| 5,578,434 A | * | 11/1996 | Moizo et al. | 430/483 |
| 5,851,742 A | * | 12/1998 | Nishio | 430/465 |
| 5,869,223 A | * | 2/1999 | Roussilhe | 430/99 |
| 5,962,182 A | | 10/1999 | Katoh | 430/398 |

FOREIGN PATENT DOCUMENTS

| | | |
|---|---|---|
| EP | 0649055 | 4/1995 |
| JP | 8146572 | 6/1996 |

OTHER PUBLICATIONS

European Search Report EP 00 11 1807.
Patent Abstracts of Japan, Publication #08146572, Publication date: Jul. 6, 1996.

* cited by examiner

*Primary Examiner*—Hoa Van Le
(74) *Attorney, Agent, or Firm*—Bierman, Muserlian and Lucas

(57) ABSTRACT

A processing method of a silver halide light sensitive photographic material by the use of an automatic processor is disclosed, in which a developing solution contains a developing agent represented by the formula described below and a developer replenishing solution having activity lower than that of a developing solution used at the time of starting processing is replenished within a predetermined amount to be replenished per unit time, and when the replenished amount of the developer replenishing solution has exceeded the predetermined amount to be replenished per unit time, a developer replenishing solution having higher activity is replenished.

6 Claims, 1 Drawing Sheet

PROCESSING METHOD OF SILVER HALIDE LIGHT SENSITIVE PHOTOGRAPHIC MATERIAL

FIELD OF THE INVENTION

The present invention relates to a method for processing a silver halide light sensitive photographic material (hereinafter, also referred to as photographic material), a processing apparatus of the photographic material and a processing system of the photographic material; in particular, to a processing method of a silver halide light sensitive photographic material, thereby leading to superior reproducibility in high contrast images and improvement in staining in processing.

BACKGROUND OF THE INVENTION

In the field of photographic arts, methods of processing surface latent image type silver halide photographic materials containing hydrazine derivatives with a stable hydroquinone-metol developer (so-called MQ developer) or hydroquinone-phenidone developer (PQ developer) have been proposed and put into practical use as a system for forming ultra-high contrast images to achieve superior reproduction of continuous tone images through half-tone dots or reproduction of line images. In these development systems, however, dihydroxybenzene developing agents have been employed, and the use of hydroquinone has met with some doubt due to its potential toxicity to human skins and is also disadvantageous in regard to ecological and environmental consideration.

Recently, ascorbic acid and its derivatives have received attentions as a developing agent from the ecological and environmental points of view. WO93/11,456 and U.S. Pat. No. 5,236,816 disclose a method of processing a silver halide photographic material containing a hydrazine compound by the use of ascorbic acid as a developing agent. In the practical running process, however, it was proved to be insufficient in lowering of contrast and reproducibility of the original, and it is therefore desired to solve such problems. As a result of studies of the inventors of the present invention, it was found that specifically, in cases when ascorbic acid or its derivatives are used as a developing agent and the processing amount of photographic material is small, the problems concerning lowering contrast, reproducibility of original, sensitivity and silver sludge are marked.

In photographic processing, further, reduction of processing effluents is desired from the environmental consideration and a technique for reducing replenishment of developer and fixer solutions is desired. However, it was further proved that a processing system at a lower replenishing rate causes excessively highconcentration of the processing solution (such as developing or fixing solution) in the tank of automatic processors as the processing amount per unit time is reduced, resulting in adverse effects in processing performance during developing and fixing, and improvements thereof are therefore desired.

SUMMARY OF THE INVENTION

It is an object of the present invention to provide a method for processing a silver halide photographic material and a processing apparatus by the use thereof, thereby enabling ascorbic acid and its derivatives to use as a developing agent and achieving superior reproducibility of originals, without reduction in photographic contrast and sensitivity and causing silver sludge, even when processed at a low replenishing rate or the processing amount is decreased.

The object of the present invention mentioned above can be accomplished by the following constitution:

1. A method for processing a silver halide light sensitive photographic material comprising the steps of:
   (a) developing an exposed photographic material with a developer solution,
   (b) fixing the developed photographic material with a fixer solution, and
   (c) washing with water or stabilizing with a stabilizer solution the fixed photographic material, wherein the photographic material comprises a support and a silver halide emulsion layer, and the developer solution comprises a compound represented by formula (2) as a developing agent, and
   wherein in step (a), a first developer replenishing solution exhibiting activity lower than that of a developer mother solution used at the start of processing is replenished, a first amount to be replenished with the first developer replenishing solution is predetermined in terms of volume per prescribed unit time, so that when the replenished amount of the first developer replenishing solution exceeds the first amount within the prescribed unit time, a second developer replenishing solution exhibiting activity higher than that of the first developer replenishing solution is replenished thereafter:

formula (2)

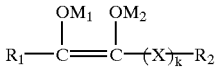

wherein $R_1$ and $R_2$ are each a substituted or unsubstituted alkyl group, a substituted or unsubstituted amino group, a substituted or unsubstituted alkoxy group, or a substituted or unsubstituted alkylthio group, provided that $R_1$ and $R_2$ may combine together with each other to form a ring; k is 0 or 1; when k is 1, X is —CO— or —CS—; and $M_1$ and $M_2$ are each a hydrogen atom or an alkali metal atom;

2. The processing method described in 1., wherein the second developer replenishing solution exhibits activity substantially equivalent to that of the developer mother solution used at the start of developing;
3. The processing method described in 1., wherein the silver halide photographic material comprises a compound represented by the following formula (1):

formula (1)

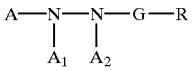

wherein A is an aryl group or a heterocyclic group containing an oxygen atom or a sulfur atom; G is —(CO)n—, sulfonyl group, sulfoxy group, —P(=O)$R_{22}$—, or iminomethylene group, in which n is an integer of 1 or 2 and $R_{22}$ is an alkyl, alkenyl, alkynyl, aryl, alkoxy, alkenyloxy, alkynyloxy, aryloxy or amino group; $A_1$ and $A_2$ are both hydrogen atoms, or either of them is a hydrogen atom and the other is a substituted or unsubstituted alkylsulfonyl group or a substituted or unsubstituted acyl group; and R is a hydrogen atom or a substituted or unsubstituted alkyl, alkenyl, aryl, alkoxy, alkenyloxy, aryloxy, heterocyclic-oxy, amino or carbamoyl group or oxycarbonyl group;

4. The processing method described in 1., wherein in step (b), a first fixer replenishing solution having a fixing agent content less than that of a fixer mother solution used at the start of processing is replenished, a first amount to be replenished with the first fixer replenishing solution is predetermined in terms of volume per prescribed unit time, so that when the replenished amount of the first fixer replenishing solution exceeds the first amount-within the prescribed unit time, a second fixer replenishing solution having a fixing agent content more than the first fixer replenishing solution is replenished thereafter;

5. The processing method described in 1., wherein the second fixer replenishing solution has a fixing agent content substantially equivalent to that of the fixer mother solution used at the start of processing;

6. An apparatus for processing a silver halide light sensitive photographic material comprising:
   a developing section to develop an exposed photographic material with a developing solution,
   a fixing section to fix the developed photographic material with a fixer solution, and
   a washing or stabilizing section to wash with water or to stabilize with a stabilizer solution the fixed photographic material, wherein the apparatus further comprises:
   a developer replenishing section to replenish a first developer replenishing solution exhibiting activity lower than that of a developer mother solution used at the start of processing to the developing section,
   a memory section to memorize a predetermined first amount to be replenished with the first developer replenishing solution in terms of volume per prescribed unit time or a predetermined amount of the photographic material to be processed per prescribed unit time, and
   a detecting section to detect the amount of the first developer replenishing solution replenished per prescribed unit time or an amount of the photographic material processed per prescribed unit time;
   and wherein when the detecting section detects that the amount of the first developer replenishing solution replenished exceeds the predetermined first amount memorized in the memory section within the prescribed unit time or when the amount of the photographic material processed exceeds the predetermined amount memorized in the memory section within the prescribed unit time, the developer replenishing section replenishes a second developer replenishing solution exhibiting higher activity than the first developer replenishing solution to the developing section;

7. A processing system of a silver halide light sensitive photographic material comprising:
   a processing apparatus comprising
      a developing section to develop an exposed photographic material with a developing solution,
      a fixing section to fix the developed photographic material with a fixer solution, and
      a washing or stabilizing section to wash with water or to stabilize with a stabilizer solution the fixed photographic material; and
      a developing solution;
         wherein the developer solution contains a compound represented by formula (2);

wherein the apparatus further comprises:
   a developer replenishing section to replenish a first developer replenishing solution exhibiting activity lower than that of a developer mother solution used at the start of processing to the developing section,
   a memory section to memorize a predetermined first amount to be replenished with the first developer replenishing solution in terms of volume per prescribed unit time or a predetermined amount of the photographic material to be processed per prescribed unit time, and
   a detecting section to detect the amount of the first developer replenishing solution replenished per prescribed unit time or an amount of the photographic material processed per prescribed unit time;
   and wherein when the detecting section detects that the amount of the first developer replenishing solution replenished exceeds the predetermined first amount memorized in the memory section within the prescribed unit time or when the amount of the photographic material processed exceeds the predetermined amount memorized in the memory section within the prescribed unit time, the developer replenishing section replenished a second developer replenishing solution exhibiting activity higher than the first developer replenishing solution to the developing section:

formula (2)

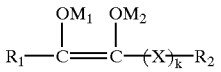

wherein $R_1$ and $R_2$ are each an alkyl group, an amino group, an alkoxy group, or an alkylthio group, provided that $R_1$ and $R_2$ may combine together with each other to form a ring; k is 0 or 1; when k is 1, X is —CO— or —CS—; and $M_1$ and $M_2$ are each a hydrogen atom or an alkali metal atom;

8. A method for processing a silver halide light sensitive photographic material comprising on a support a silver halide emulsion layer, the method comprising continuously processing the photographic material by the use of an automatic processor, wherein at least one selected from the emulsion layer and other hydrophilic layer(s) contains a hydrazine compound represented by the following formula (1) and the developing solution containing a compound represented by the following formula (2) as a developing agent, and wherein a developer replenishing solution having activity lower than that of a developing solution used at the time of starting processing is replenished within a predetermined amount to be replenished per unit time, and when the replenished amount of the developer replenishing solution has exceeded the predetermined amount to be replenished per unit time, a developer replenishing solution having activity substantially equivalent to that of the developing solution used at the time of starting processing is replenished:

formula (1)

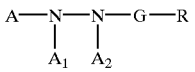

wherein A is an aryl group or a heterocyclic group containing an oxygen atom or a sulfur atom; G is —(CO)n—, sulfonyl group, sulfoxy group, —P(=O)$R_{22}$—, or iminomethylene group, and n is an integer of 1 or 2, in which $R_{22}$ is a substituted or unsubstituted alkyl, alkenyl, alkynyl, aryl, alkoxy, alkenyloxy, alkynyloxy, aryloxy or amino group; $A_1$ and $A_2$ are both hydrogen atoms, or either of them is a hydrogen atom and the other is a substituted or unsubstituted alkylsulfonyl group or a substituted or unsubstituted acyl group; R is a hydrogen atom or a substituted or unsubstituted alkyl, alkenyl, aryl, alkoxy, alkenyloxy, aryloxy, heterocyclic-oxy, amino or carbamoyl group or oxycarbonyl group;

formula (2)

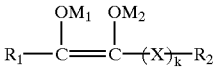

wherein $R_1$ and $R_2$ are each a substituted or unsubstituted alkyl group, a substituted or unsubstituted amino group, a substituted or unsubstituted alkoxy group, or a substituted or unsubstituted alkylthio group, provided that R1 and R2 may combine together with each other to form a ring; k is 0 or 1; when k is 1, X is —CO— or —CS—; and $M_1$ and $M_2$ are each a hydrogen atom or an alkali metal atom; and 9. A method for processing a silver halide light sensitive photographic material comprising on a support a silver halide emulsion layer, the method comprising continuously processing the photographic material by the use of an automatic processor, wherein at least one selected from the emulsion layer and other hydrophilic layer(s) contains a hydrazine compound represented by the above-described formula (1), and wherein a fixer replenishing solution having a fixing agent content lower than that of a fixing solution used at the time of starting processing is replenished within a predetermined amount to be replenished per unit time, and when the replenished amount of the fixer replenishing solution has exceeded the predetermined amount to be replenished per unit time, a fixer replenishing solution having a fixing agent content substantially equivalent to that of the fixing solution used at the time of starting processing is replenished.

DETAILED DESCRIPTION OF THE INVENTION

Figure 1:
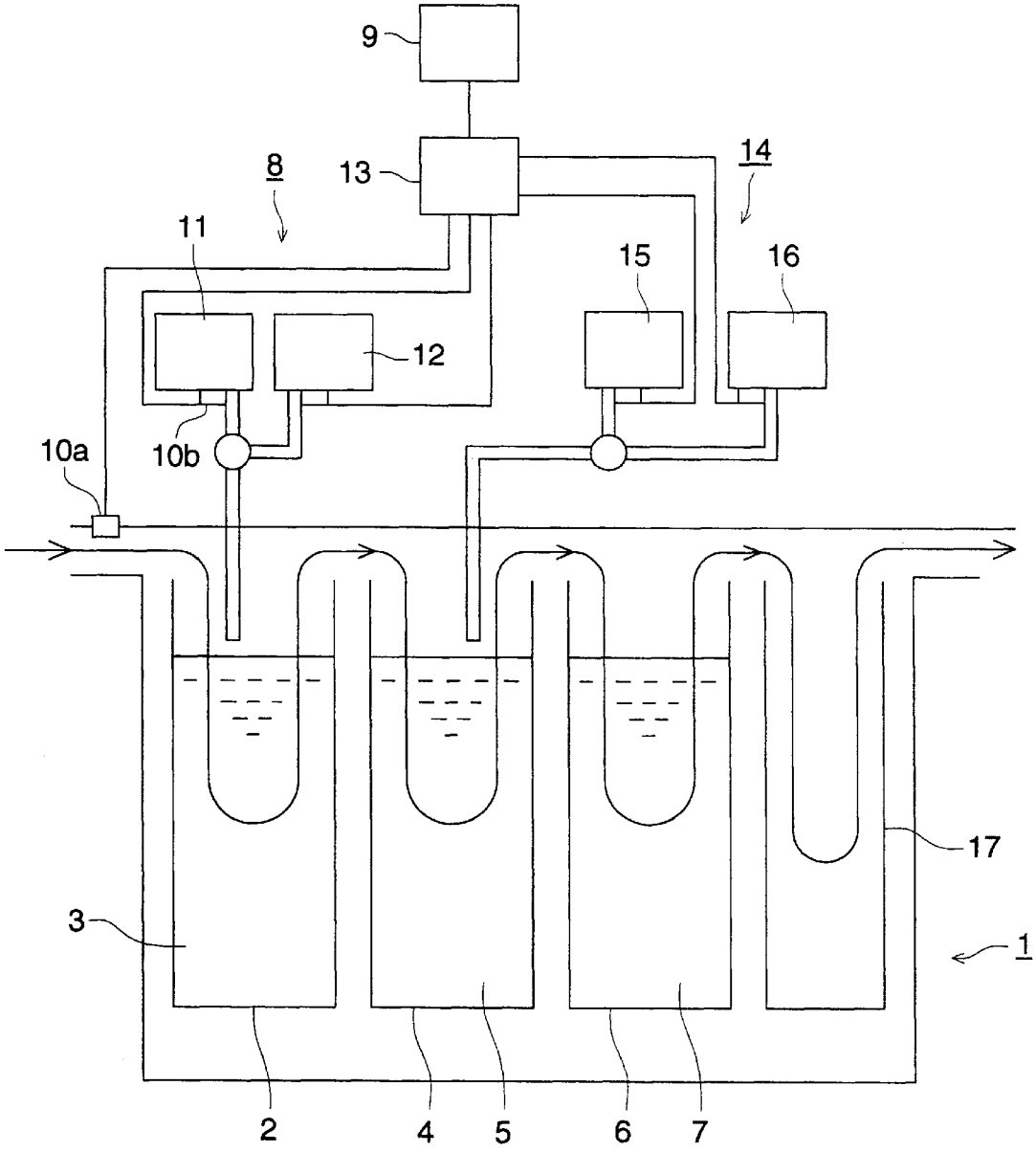
FIG. 1 illustrates of processing system and a processing apparatus according to the invention.

Hydrazine compounds contained in the silver halide photographic material used in the invention will now be described. Of the compounds represented by formula (1), a compound represented by the following formula (1a) is preferred:

formula (1a)

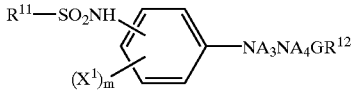

wherein $R^{11}$ is an aliphatic group (e.g., octyl, decyl), an aromatic group (e.g., phenyl, 2-hydroxyphenyl, chlorophenyl), or a heterocyclic group (e.g., pyridyl, thienyl, furyl), each of which may be substituted. Specifically, $R^{11}$ having a ballast group or a group promoting adsorption onto silver halide is preferred. Ballast groups are preferably those which are commonly used in non-diffusible photographic-additives such as couplers, and having 8 or less carbon atoms, such as alkyl, alkenyl, alkynyl, alkoxy, phenyl and alkylphenoxy. Examples of the group promoting adsorption onto silver halide include a thiourea group, a thiourethane group, mercapto group, a thioether group, a heterocyclic group, a thioamino-heterocyclic group, a mercapto-heterocyclic group and adsorbing groups described in JP-A 64-90439 (hereinafter, the term, JP-A means a unexamined and published Japanese Patent Application). In formula (1a), $X^1$ is a group capable of being substituted on a phenyl group; m is an integer of 0 to 4, provided that when m is 2 or more, $X^1$ may be the same or different. In formula (1a), $A^3$ and $A^4$ are the same as defined in $A^1$ and $A^2$, and are preferably both hydrogen atoms. In formula (1a), G is the same as defined in G in formula (1) and is preferably a carbonyl group.

In formula (1a), $R^{12}$ is a hydrogen atom, or a substituted or unsubstituted alkyl, alkenyl, alkynyl, aryl or heterocyclic group, hydroxy, a substituted or unsubstituted amino, carbamoyl or oxycarbonyl group; specifically, $R^{12}$ is preferably a substituted alkyl group, in which the carbon atom attached to G is attached to an electron-withdrawing group, —$COOR^{13}$ or —$CON(R^{14})(R^{15})$, in which $R^{13}$ is an alkynyl group or a saturated heterocyclic group, $R^{14}$ is a hydrogen atom, an alkyl group, an alkenyl group, alkynyl group, aryl group or a heterocyclic group; and $R^{15}$ is an alkenyl group, an alkynyl group, a saturated heterocyclic group, hydroxy, or an alkoxy group. $R^{12}$ is more preferably a substituted alkyl group, in which the carbon atom attached to G is attached to two electron-withdrawing groups (still more preferably three electron-withdrawing groups). The electron-withdrawing group attached to the carbon atom of $R^{12}$, which is attached to G, is preferably one which has a σp of 0.2 or more and σm of 0.3 or more (in which σp and σm are each a Hammett's substitution constant). Examples thereof include halogen, cyano, nitro, nitroso, polyhaloalkyl group, polyhaloaryl group, alkyl- or aryl-carbonyl group, formyl, alkyl- or aryl-oxycarbonyl group, alkylcarbonyloxy group, carbamoyl group, alkyl- or aryl-sulfinyl group, alkyl- or aryl-sulfonyl group, alkyl- or aryl-sulfonyloxy group, sulfamoyl group, phosphine group, phosphineoxide group, phosphone ester group, phosphoneamido group, arylazo group, amidino group, ammonoi group, sulfonoi group, and electron-deficient heterocyclic group. In formula (1a), R12 is specifically preferably a fluorine-substituted alkyl group, such as monofluoromethyl, difluoromethyl and trifluoromethyl.

Exemplary examples of the compounds represented by formula (1) are shown below, but are not limited to these.

1-1

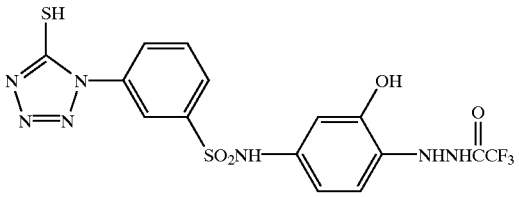

1-2

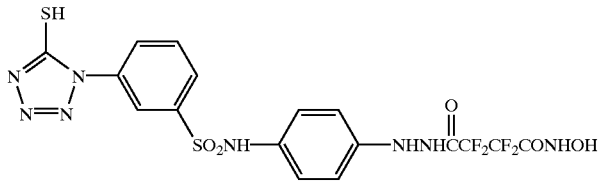

1-3

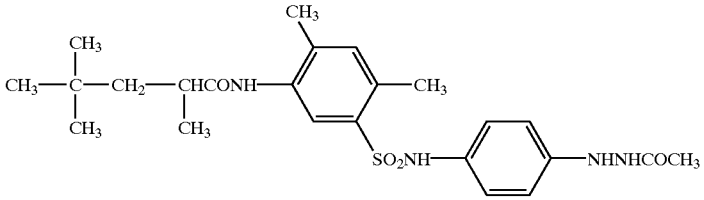

1-4

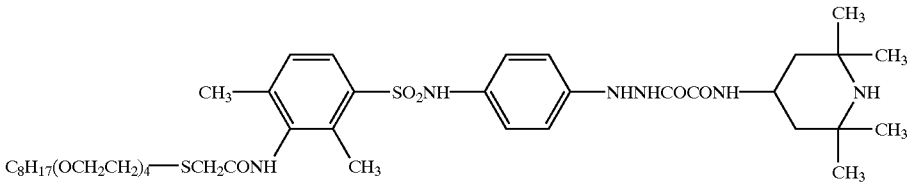

1-5

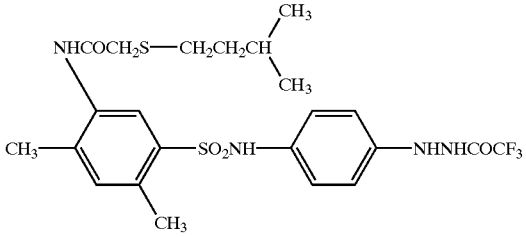

As other specific examples of hydrazine compounds, for example, those Exemplified Compounds (1) through (252 disclosed on columns 4 through 60 of U.S. Pat. No. 5,229,248 can be mentioned. The hydrazine compounds according to the present invention can be synthesized according to the conventionally known methods in the art. For example, they may be synthesized according to the method disclosed on columns 59 through 80 in the U.S. Pat. No. 5,229,248. An adding amount of the hydrazine derivative may be optional if it is one capable of hardening the light-sensitive photographic material according to the present invention, and the optimum amount of addition may be varied depending on the grain size of the silver halide particles, halide composition, degree of chemical ripening and kind of restraining agent, etc., however, it is generally between $10^{-6}$ and $10^{-1}$ mol, and, more preferably, between $10^{-5}$ and $10^{-2}$ mol per one mol of silver halide. Hydrazine compounds are incorporated into at least a layer on emulsion-side, preferably a silver halide emulsion layer and/or its adjacent layer, and more preferably a silver halide emulsion layer. The hydrazine content in a layer closest to the support among hydrazine-containing layer(s) is preferably 0.2 to 0.8 mol equivalent, and more preferably 0.4 to 0.6 mol equivalent, based on the total hydrazine content in the whole photographic component layers. The hydrazine compounds are used alone or in combination.

In cases where the photographic material to be processed contains the nucleating agent described above, it is preferred to use a nucleation-promoting agent. Examples thereof include exemplary compounds (2-1) through (2-20) described in JP-A 6-258751, compounds (3-1) through (3-6) described in JP-A 6-258751, onium compounds described in JP-A 7-270957, compounds represented by general formula I described in JP-A 7-104420, and thiosulfonic acid compounds described in JP-A 2-103536, page 17, right lower column line 19 to page 18, right upper column, line 4, and page 18, lower right column line 1–5, and JP-A 1-237538. The nucleation-promoting agent may be incorporated into any layer of photographic component layers on emulsion-side, and preferably into a silver halide emulsion layer or its adjacent layer. The amount to be incorporated, depending of the grain size, halide composition, the extent of chemical sensitization of silver halide grains and the kind of a restraining agent, is preferably $10^{-6}$ to $10^{-1}$ mol, and more preferably $10^{-5}$ to $10^{-2}$ mol per mol of silver halide.

The layer arrangement of photographic materials used in the invention is preferably comprised of a subbing layer, emulsion layer and a protective layer coated on a support in this order, and a backing layer is preferably provided on the opposite side of the support. Each layer may be comprised of two or more layers. There may be provided constituting layer(s) other than the layers described above.

Halide composition of silver halide grains contained in a silver halide emulsion of the photographic material is not specifically limited. In cases where subjected to processing at a low replenishing rate or subjected to rapid processing, a silver halide emulsion is preferred, comprising silver chloride, silver bromochloride containing 60 mol % or more chloride or silver iodobromochloride containing 60 mol % or more chloride.

The average grain size of the silver halide is preferably 1.2 μm or less, and, more preferably 0.8 to 0.1 μm. The term "average grain size" has been used commonly in the art. The term "grain size" usually refers to a diameter of the grain, when the grain is of spherical shape or in the form close thereto. In the case when the grain is a cubic shape, it means a diameter of a sphere when the cube is converted into a sphere having the equivalent volume. With regard to the method of obtaining the average diameter, one can refer to the disclosure on pages 36–43, third edition of C. E. K. Mees and T. H. James "The theory of the Photographic Process", pages 36–43, Macmillan Co.(1966).

There is no limitation as to the shape of the silver halide grain, and any one of tabular, cubic, spherical, tetradecahedral or octahedral shape can optionally be used. Concerning grain size distribution, the narrower, the more preferable. Particularly, so-called mono-dispersed emulsion, in which not less than 90%, preferably, 95% of the total number of grains fall within the range of the average grain size ±40%, is preferable.

The type of reaction of a soluble silver salt with soluble halide in the preparation of a silver halide emulsion may be normal precipitation, double jet precipitation or combination thereof. A method of forming grains in the presence of silver ions in excess (so-called, reversed precipitation) may be applicable. As one of the double jet precipitation is used a controlled double jet method in which the pAg of liquid phase is maintained at a given value during the course of grain formation. According to this method, there can be obtained a silver halide emulsion comprised of monodisperse grains with regular crystal form.

To effectuate the present invention, tabular grains are preferably contained in a silver halide emulsion layer of the silver halide photographic light sensitive material. The tabular grains having an aspect ratio of 2 or more account for 505 or more of the projected area of the total grains contained in the silver halide emulsion layer. The tabular grains account for preferably 60 to 70%, more preferably 80% or more of the total grain projected area. The term, "aspect ratio" is referred to as a ratio of a diameter of a circle having the area equivalent to the grain projected area to a spacing between two parallel major faces (i.e., thickness).

Among these tabular grains, are preferably used those having a chloride content of 50 mol % or more and (100) major faces, which can be readily prepared according to the manner described in U.S. Pat. Nos. 5,264,337, 5,314,798, and 5,320,958. On a specific site of the tabular grains, different silver halide can be epitaxially grown up or shelled. The tabular grains may have dislocation lines on the surface or in the interior of the grain to control sensitivity speck. The dislocation line can be formed by allowing fine silver iodide grains to be present or adding a soluble iodide during the course of chemical sensitization. With respect to preparation of the grains, acidic precipitation, neutral precipitation and ammoniacal precipitation may be optionally selected. In cases where metal is doped within the grain, it is preferred to form grains under the acidic condition of a pH of 1 to 5. To control grain growth during the course of grain formation is used a silver halide solvent, such as ammonia, thioethers, thiourea compounds, and thione compounds. The thioethers include 3,6,9,15,21-hexaoxa-12-thiatricosane; 3,9,15-trioxa-6,12-dithiaheptadecane;1,17-dioxy-3,9,15-tioxa-6,12-dithiaheptadecane-4,14-dione;1,20-dioxy-3,9,12,18-teraoxa-6,15-dithiaeicisane-4,17-dione; and 7,10-dioxa-4,13-dithiahexadecane-2,15, dicarboxamide, as described in German Patent 1,147,845. Oxathioethers described in JP-A 56-94347 and 1-121847 and cyclic oxathioethers described in JP-A 63-259653 and 63-301939 are also cited. Thioureas described in JP-A 53-82408 are usable. As exemplary examples thereof are cited tetramethylthiourea, tetraethylthiourea, dimethylpiperidinothiourea, dimorphorinothiourea; 1,3-dimethylimidazole-2-thione; 1,3-dimethylimidazole-4-phenyl-2-thione; and tetrapropylthiourea.

At the time of physical ripening or chemical ripening, metal salts of zinc, lead, thallium, iridium, rhodium, ruthenium, osmium, paradium, platinum, etc. can be coexisted. It is often commonly used to incorporate $10^{-8}$–$10^{-3}$ of iridium per mol silver halide for the purpose of improving high intensity reciprocity law failure characteristics. In the present invention, in order to obtain an emulsion with high contrast, it is preferable for $10^{-9}$ to $10^{-3}$ mol of rhodium, ruthenium, osmium and/or rhenium per mol of silver halide to be incorporated in the silver halide emulsion.

A metal compound may be added in the form of a complex salt, in which the metal is coordinate with a halogen, carbonyl, nitrocyl, thionitrocyl, amine, cyan, thiocyan, ammonia, tellurocyl, selenocyan, dipyridyl, tripyridyl, phenanthroline or a combination thereof. The oxidation state of the metal may be optionally selected within the range of the minimum level to the maximum level. As preferred ligands are cited hexa-dentated ligands described in JP-A 2-2082, 2-20853, 2-20854 and 2-20855; alkali metal salts include a sodium salt, potassium salt and cesium salt and primary secondary and tertiary amines are also cited. A transition metal complex salt may be formed in the form of an aquo-complex. Examples thereof include $K_2[RuCl6]$, $(NH_4)_2[RuCl_6]$, $K_2[Ru(NOCl_4(SCN))$, and $K_2[RuCl_5(H_2O)]$. Ru may be replaced by Rh, Os, Re, Ir, Pd or Pt. It is preferable that rhodium, ruthenium, osmium and/or rhenium compound is added during the time of forming silver halide grains. Addition thereof may be optional, including a method of distributing uniformly inside the grain and a method of localizing in the core or shell portion of core/shell-structure grains. Often, better results are obtained in the case when they are made present in the shell portion. Further, in the case when they are made present in a discrete layer structure, a method in which amount of presence is made greater depending on the distance from the center of the grain, may also be applied. Amount of addition may optionally be selected from the range between $10^{-9}$ and $10^{-3}$ mol per mol of silver halide.

Silver halide emulsions and preparation methods thereof are referred to Research Disclosure 17643 pages 22–23 (December 1973) and the references referred therein.

The silver halide emulsion used in the present invention may or may not be chemically sensitized. As method of chemical sensitization, sulfur sensitization, selenium sensitization, tellurium sensitization, reduction sensitization and noble metal sensitization have been well known in the art, and these methods may be used either singly or in combination. As a sulfur sensitizer, conventionally known sulfur sensitizers may be used. Preferable sulfur sensitizers include, besides sulfur compounds contained in gelatin, various sulfur compounds, for example, thiosulfates, thio ureas, rhodanines, polysulfide compounds, etc. can be used. As selenium sensitizers, known selenium sensitizers may be used. For example, those compounds disclosed in U.S. Pat. No. 1,623,499, JP-A 50-71325 and 60-150046 may preferably be used.

In the photographic itive material used in the invention can comprise a variety of compounds for the purpose of preventing fog during manufacture, storage or photographic processing of the light-sensitive material. Those compounds include compounds which are known as stabilizers or antifoggants in the art. For example, azoles such as benzthiazolium salts, nitroindazoles, chlorobenzimidazoles, bromobenzimidazoles, mercaptothiazoles, mercaptobenzthiazoles, mercaptobenzimidazoles, mercaptobenzthiadiazoles, aminotriazoles, benztriazoles, nitrobenztriazoles, mercaptotetrazoles, such as 1-phenyl-5-mercaptotetrazole, etc.; mercaptopyrimidines, mercaptotriazines, thioketo compounds such as oxazolinethione; azaindenes such as triazaindenes, tetrazaindenes including 4-hydroxy-substituted 1,3,3a,7-tetrazaindenes, pentazaindenes, etc., benzenethiosulfonic acid, benzenesulfinic acid, benzenesulfonic acid amide, etc. can be mentioned.

As binder or a protective colloid of the photographic emulsion used in the present invention, gelatin is advantageously used, however, other hydrophilic colloids may also be used. The hydrophilic colloids include, for example, gelatin derivatives, graft polymers comprised of gelatin and other polymers; proteins such as casein, albumin, etc.; cellulose derivatives such as hydroxyethyl cellulose, carboxymethyl cellulose, cellulose sulfates, etc.; sugar derivatives such as sodium alginate, starch derivatives, etc.; synthetic hydrophilic polymers such as polyvinyl alcohol and partial acetal thereof, poly-N-pyrrolidone, polyacrylic acid, polymethacrylic acid, polyacrylamide, polyvinyl imidazole, polyvinyl pyrazole, etc. These polymers may be either homopolymers or copolymers. As gelatin, there may be usable an acid process gelatin as well as lime-processed gelatin. Further, hydrolytic products or enzyme decomposition products of gelatin may also be used. Polysaccharides such as dextran and dextrins described in JP-A 9-304855 may also be used to emhance rapid processablity.

In the photographic emulsion used in the present invention, for the purpose of improving dimensional stability, etc., synthetic polymers which are water-insoluble, or sparingly water-soluble can be incorporated. For example, alkyl(metha)acrylates, alkoxy(metha)acrylates, glycidyl(metha)acrylates, (metha)acrylamides, vinyl esters such as vinyl acetate, acrylonitrile, styrene, etc. may be used either singly or in combination. Further, these polymers may be used in the form of a copolymer together with other monomer constituents such as acrylic acid, methacrylic acid, α,β-unsaturated dicarboxylic acid, hydroxylalkyl(metha) acrylate, sulfoalkyl(metha)acrylate, styrene sulfonic acid, etc.

A silver halide emulsion layer or light-insensitive hydrophilic colloidal layer used in the invention may contains an or inorganic hardener, such as chromium salts (chrome alum, chrome acetate etc.), aldehydes (formaldehyde, glutar aldehyde, glyoxal etc.), N-methylol compounds (dimethylol urea, dimethylol dimethylhydantoin etc.), dioxane derives (2,3-dihydroxydioxane), active vinyl compounds (1,3,5-triacryloyl-hexahydro-s-triazine, bis)vinylsulfonyl)methyl ether, N,N-methylenebis-[β-(vinylsulfonyl)propioneamide], etc.), active halogen compounds (2,4-dichloro-6-hydroxy-s-triazine, etc.), mucohalogenic acids (mucochloric acid, phenoxymucochloric acid, etc.)isooxazoles, dialdehyde starch, 2-chloro-6-hydroxytriazinyl gelatin, and carbonyl group-activating type hardeners, singly or in combination thereof. These hardeners are described in Research Disclosure Vol. 176, item 17643 (December, 1978), page 26, section A-C.

Various additives are further employed in the photographic material relating to the invention, including a desensitizer, plasticizer, lubricant, development accelerating agent and oil.

A support used in the present invention may be a transparent or nontransparent one, and a transparent plastic resin support is preferred for the purpose of the invention. As the plastic resin support may be employed a support comprising a polyethylene compound (e.g., polyethylene terephthalate, polyethylene naphthalate), a triacetate compound (e.g., triacetate cellulose), or polystyrene compound.

The thickness of the support is preferably 50 to 250 μm and more preferably 70 to 200 μm. To make improvements in roll set curl, it is preferred to subject to heat treatment after casting of base. The treatment is most preferably after casting of base and before emulsion coating, but it may be made after emulsion coating. The condition for the heat treatment at a temperature of not lower than 45° C. and not higher than a glass transition temperature and over a period of one second to ten days is preferred. From the point of productivity is preferred a period within one hour.

In the invention, the following compounds are preferably contained in a silver halide photographic light sensitive material.

(1) Dye in the Form of a Fine Solid Particle Dispersion:

Compounds described in JP-A 7-5629 page 3, [0017] to page 16 [0042].

(2) Compound having an Acidic Group:

Compounds described in JP-A 62-237445 page 3, left lower column line 11 to page 25, right lower column line 3.

(3) Acidic Polymer:

Compounds described in JP-A 6-186659 page 10, [0036] to page 17 [0062].

(4) Sensitizing Dye:

Compounds described in JP-A 5-224330 page 3, [0017] to page 13 [0040].

Compounds described in JP-A 6-194771 page 11, [0042] to page 22 [0094].

Compounds described in JP-A 6-242533 page 2, [0015] to page 8 [0034].

Compounds described in JP-A 6-337492 page 3, [0012] to page 34 [0056].

Compounds described in JP-A 337494 page 4, [0013] to page 14 [0039].

(5) Supersensitizer:

Compounds described in JP-A 6-347938 page 3, [0011] to page 16 [0066].

(6) Hydrazine Derivatives:

Compounds described in JP-A 7-114126 page 23, [0111] to page 32, [0157].

(7) Nucleation Promoting Agent:

Compounds described in JP-A 7-114126 page 32 [0158] to page 36 [0169].

(8) Tetrazolium Compound:

Compounds described in JP-A 6-208188 page 8 [0059] to page 10 [0067].

(9) Pyridinium Compound:

Compounds described in JP-A 7-110556 page 5 [0028] to page 29 [0068].

(10) Redox Compound:

Compounds described in JP-A 4-245243 page 7 to page 22.

(11) SPS Support:

Supports described in JP-A 3-54551.

The above described additives and other known additives are referred to Research Disclosure No. 17643 (December, 1978) pages 23 to 29; ibid No. 18716 (November, 1979) pages 648 to 651; ibid No. 308119 (December, 1989) pages 996 to 1009.

Photographic materials used in the invention are processed preferably with an automatic processor having at least four processes of developing, fixing, washing (or stabilizing) and drying.

In developer used in the invention is used commonly known developing agents, including dihydroxybenzenes (e.g., hydroquinone, hydroquinone monosulfonate), 3-pyrazolidones (e.g., 1-phenyl-3-pyrazolidne, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone), aminophenols (e.g., o-aminophenol, p-aminophenol, N-methyl-o-aminophenol, N-methylp-aminophenol, 2,4-diaminophenol), ascorbic acids (e.g., ascorbic acid, sodium ascorbate, erythorbic acid) and metal complexes (e.g., EDTA iron salts, DTPA iron salts, DTPA nickel salts). These are used alone or in combination. Of these is preferably used a developing agent represented by the foregoing formula (2).

In formula (2), $R_1$ and $R_2$ combine together with each other to form a ring, and the resulting compound represented by the following formula (2-a) is specifically preferred:

formula (2-a)

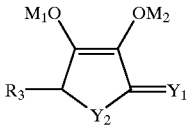

In the formula, $R_3$ is a hydrogen atom, substituted or unsubstituted alkyl group, substituted or unsubstituted aryl group, substituted or unsubstituted amino group, substituted or unsubstituted alkoxy group, sulfo group, carboxy group, amido group or sulfonamido group; $Y_1$ is O or S; $Y_2$ is O, S or $NR_4$, in which $R_4$ is substituted or unsubstituted alkyl group or substituted or unsubstituted aryl group; and $M_1$ and $M_2$ each are a hydrogen atom or alkali metal atom.

As the alkyl group of formula (2) and formula (2-a) is preferred a lower alkyl group, such as an alkyl group having 1 to 5 carbon atoms; the amino group is preferably unsubstituted amino group or amino group substituted by a lower alkoxy group; the alkoxy group is preferably a lower alkoxy group; the aryl group is preferably a phenyl group or naphthyl group; these groups may be substituted and as substituents are cited hydroxy group, halogen atom, alkoxy group, sulfo group, carboxy group, amido group, and sulfonamido group. $M_1$ and $M_2$ each are a hydrogen atom or alkali metal atom, preferably sodium or potassium atom.

Exemplary examples of the compound represented by formulas (2) and (2-a) are shown below, but the compounds are not limited thereto. The content of the compound of formula (2) or (2-a) in the developer solution is 0.1 to 1.0 mol/l, and more preferably 0.1 to 0.6 mol/l.

Formula (2)

| Compound No. | X | $R_1$ | $R_2$ | $M_1$ | $M_2$ |
|---|---|---|---|---|---|
| 2-1 | — (k = 0) | $HOCH_2$—CH(OH)—CH(OH)— | —OH | H | H |
| 2-2 | — (k = 0) | $CH_3$—CH(OH)—CH(OH)— | —OH | H | H |
| 2-3 | — (k = 0) | $HOCH_2$—CH(OH)—CH(OH)— | —$CH_3$ | H | H |
| 2-4 | — (k = 0) | $CH_3$—CH(OH)—CH(OH)— | —$CH_3$ | H | H |
| 2-5 | —C(=O)— (k = 1) | $HOCH_2$—CH(OH)—CH(OH)— | —OH | H | H |
| 2-6 | —C(=O)— (k = 1) | $CH_3$—CH(OH)—CH(OH)— | —OH | H | H |
| 2-7 | —C(=S)— (k = 1) | $HOCH_2$—CH(OH)—CH(OH)— | —OH | H | H |
| 2-8 | —C(=S)— (k = 1) | $CH_3$—CH(OH)—CH(OH)— | —OH | H | H |
| 2-9 | —C(=O)— (k = 1) | HO—$CH_2$— | —OH | Na | H |
| 2-10 | —C(=O)— (k = 1) | HO—$CH_2$— | —$CH_3$ | H | H |

-continued

| | | | | | |
|---|---|---|---|---|---|
| 2-11 | $-\overset{O}{\overset{\|\|}{C}}-$ (k = 1) | $HO-CH_2-$ | $-C_2H_5$ | H | H |
| 2-12 | $-\overset{O}{\overset{\|\|}{C}}-$ (k = 1) | $HO-CH_2-$ | $-C_2H_4OH$ | H | Na |

Formula (2-a)

| Compound No. | $Y_1$ | $Y_2$ | $R_3$ | $M_1$ | $M_2$ |
|---|---|---|---|---|---|
| 2-13 | O | O | H | H | H |
| 2-14 | O | O | $CH_3$ | H | H |
| 2-15 | O | O | $CH_2$ \| OH | H | H |
| 2-16 | O | O | $CH_3-CH(OH)-$ | H | H |
| 2-17 | O | O | $HOCH_2-CH(OH)-$ | H | H |
| 2-18 | O | O | $HOCH_2-CH(OH)-$ | Na | H |
| 2-19 | O | O | $HOOCCH_2-CH(OH)-$ | H | Na |
| 2-20 | S | O | H | Na | H |
| 2-21 | S | O | $CH_3-CH(OH)-$ | H | H |
| 2-22 | S | O | $HOCH_2-CH(OH)-$ | H | H |
| 2-23 | O | $NCH_3$ | H | H | H |
| 2-24 | O | NH | $HOCH_2-CH(OH)-$ | H | K |
| 2-25 | O | S | H | H | H |
| 2-26 | O | S | $HOCH_2-CH(OH)-$ | H | H |
| 2-27 | O | S | $CH_3-CH(OH)-$ | H | H |
| 2-28 | S | S | H | H | H |
| 2-29 | S | S | $HOCH_2-CH(OH)-$ | H | H |
| 2-30 | S | S | H | H | H |

Of these compounds, representative ones are ascorbic acid, erythorbic acid or salts thereof (e.g., sodium, potassium, lithium etc.), derivatives derived therefrom, which are commercially available and readily synthesized by well known methods.

In the invention, the developing agent is referred to as a compound, which accounts for at least 50 mol % of compounds capable of developing silver halide, in a developing solution. The developing agent represented by formula (2) is used preferably in combination with a developing agent such as 3-pyrazolidones (e.g., 1-phenyl-3-pyrazolidne, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone), aminophenols (e.g., o-aminophenol, p-aminophenol, N-methyl-o-aminophenol, N-methylp-aminophenoli 2,4-diaminophenol) or hydrophilic group-substituted dihydroxybenzenes (e.g., hydroquinone monosulfonate, sodium hydroquinonemonosulfonate, potassium 2,5-hydroquinonedisulfonate). In cases where used in combination, developing agents such as 3-pyrazolidones, aminophenols or hydrophilic group-substituted dihydroxybebzenes are used preferably in an amount of not less than 0.01 mole and less than 0.2 mole per lit. of developing solution. A combination of ascorbic acid or its derivatives and 3-pyrazolidones; or a combination of ascorbic acid or its derivatives, 3-pyrazolidones, and hydrophilic group-substituted dihydroxybebzenes is preferably used.

To the developing solution may optionally be added various additives including, for example, an alkali agents such as sodium hydroxide, potassium hydroxide,etc,; pH buffers such as carbonates, phosphates, borates, boric acid acetic acid, citric acid, alkanolamine, etc. A preferred pH buffer is a carbonate in an amount of 0.4 to 1.0 mol/l (and more preferably 0.4 to 0.8 mol/l).

In cases where the compound of formula (2) is used as a developing agent, sulfites are preferably used as a preservative in an amount of 0.02 to 0.3 mol/l (and more preferably 0.1 to 0.2 mol/l).

One feature of the processing method according to the invention, in which photographic materials are-continuously processed using an automatic processor is that the first developer replenishing solution exhibiting activity lower than that of the developer mother solution used at the start of processing is replenished within-the predetermined amount to be replenished per prescribed unit time, and in cases when the amount of the first developer replenishing solution replenished has gone beyond the predetermined amount within the prescribed unit time or in cases when the amount of the photographic material processed has exceeded the predetermined amount of the photographic material to be processed per prescribed unit time, then the second developer replenishing solution exhibiting higher activity than the first developer replenishing solution is replenished.

In cases where the prescribed unit time is set to be one day, for example, the amount of the first developer replenishing solution replenished per day is predetermined taking account of oxidation deterioration, evaporation of the developing solution in the processor and the activity of a developer replenishing solution. Based thereon, the predetermined amount of photographic material processed is set. Further, the amount to be replenished with the developer replenishing solution is set in correspondence to the amount of photographic material processed. After the total amount (e.g., the volume by volume) of the first developer replenishing solution replenished has reached or exceeded the predetermined amount of the first developer replenishing solution replenished within the day while running of developing photographic material, the second developer replenishing solution exhibiting higher activity than the first developer replenishing solution is subsequently replenished. Alternatively, after the total amount of the processed photographic material has reached or exceeded the predetermined of photographic material processed per day, within the day while running of developing photographic material, the second developer replenishing solution exhibiting higher activity than the first developer replenishing solution is subsequently replenished. Further, in cases when the replenished amount of the first developer replenishing solution or the amount of processed photographic material is expected to exceed the predetermined amount thereof, the second developer replenishing solution may be replenished immediately before exceeding the predetermined amount. Effects of this invention are marked specifically at a lower replenishing rate. Specifically, the replenishing rate of the first and second developer replenishing solutions is preferably 30 to 400 ml/m$^2$, and more preferably 50 to 300 ml/m$^2$.

Herein, the developer mother solution is referred to as a developer working solution in the developing tank of an automatic processor, i.e., a developer tank solution. Accordingly, the developer mother solution used at the start of processing is referred to as a developing solution in the developing tank at the time of starting the running-process. The first developer replenishing solution, which exhibits lower activity than that of the developer mother solution is a developer solution replenished while running the process. The second developer-replenishing solution, which exhibits higher activity than the firs t developer replenishing solution and preferably exhibits activity substantially equivalent to that of the developer mother solution, is also a developer solution replenished while running the process. Herein, the expression, the activity substantially equivalent to that of the developer mother solution means that the activity is preferably within the range of 98 to 102% of the activity of the developer mother solution. Further, the relative activity of the first developer replenishing solution is preferably 30 to 90, and more preferably 70 to 90, based on the activity of the developer mother solution being 100. The relative activity of the second developer replenishing solution is preferably 90 to 150, more preferably 98 to 125, and still more preferably 98 to 102, based on the activity of the developer mother solution being 100.

The activity of a developer solution, as defined in the present invention, is represented in terms of sensitivity obtained when a silver halide photographic material (which is. called a control strip) is exposed through an optical wedge to light and developed with the developer solution. Thus, the expression, the first developer replenishing solution exhibiting activity lower than that of a developer mother solution, for example, means that sensitivity obtained when a photographic material is exposed and developed with the first developer replenishing solution is lower than that obtained when developed with the developer mother solution. To determine the activity, exemplarily, a silver halide photographic material is exposed through an optical wedge to He-Ne laser light for 10–6 sec., then, developed, fixed and washed using an automatic processor. The processed photographic material is subjected to densitometry and sensitivity is represented by a relative value of reciprocal of exposure giving a density of 2.5, based on the sensitivity obtained by developing with a fresh developer mother solution. Alternatively, silver halide photographic material is exposed, then developed, fixed and washed; the processed photographic material is subjected to densitometry and sensitivity is represented by a relative value of reciprocal of exposure giving a density of 1.5, based on the sensitivity obtained by developing with a fresh developer mother solution. The activity of a developer can be adjusted by varying the amount or kind of developer composition. For example, variation of the developer solution activity can be achieved by varying the kind or amount of the developing agent, the development inhibitor or the development accelerator, pH, or the degree of dilution of the developer solution. To lower the activity of a developer solution, it is preferred to reduce the content of the developing agent, to lower the pH of the developer solution, to increase the content of the development inhibitor, or to dilute the developer solution with water. Reduction of the developing agent is preferably done to make the developing agent content of the developer replenishing solution 70 to 98% of that of the developer mother solution at the start of processing. Lowering the pH of a developer solution is preferably to adjust the pH of the developer replenishing solution lower by 0.1 to 0.5 than that of the developer mother solution. To increase a development inhibitor, it is preferred to increase the content of the development inhibitor to an extent of 102 to 180% of that of the developer mother solution. Preferred examples of development inhibitors include inorganic inhibitors such as potassium bromide or organic inhibitors such as 5-methylbenzotriazole, 5-methylbenzimidazole, 5-nitroindazole, adenine, guanine or 1-phenyl-5-mercaptotetrazole. To dilute a developer solution with water, it is preferred to dilute the developer replenishing solution with water by 2 to 80% more than the developer mother solution. Of these, in terms of simplicity in handling, it is preferred to dilute the developer solution with water.

The first developer replenishing solution-is the thus obtained developer solution having a lower activity, preferably one obtained by diluting the developer mother solution or the second developer replenishing solution with water, adjusting the pH to a lower value, increasing the content of the development inhibitor or decreasing the content of the developing agent. Specifically, it is simplest to dilute the developer mother solution or the second developer replenishing solution with water. Further, in cases where the replenishing section of the processor has a replenisher supplying section and a replenishing water supplying section, the replenisher tank of the replenisher supplying section is filled with the second developer replenishing solution, and the second developer replenishing solution and water are added to obtain the first developer replenishing solution, having a desired activity.

To determine the replenishing amount of the first developer replenishing solution exhibiting a lower activity, activities of a fresh developer mother solution and a developer running solution are each measured, based on sensitivity, and the relationship between the sensitivity ratio thereof (i.e., activity ratio) and the replenishing amount of the first replenishing solution necessary to make the activity equivalent to that of the fresh developer mother solution is predetermined.

In cases when no photographic material has been processed, operating the automatic processor is run for a given period of time and after being allowed to stand for a given time, a control strip is developed and from the obtained sensitivity thereof is determined the amount of the first lower-active developer replenishing solution to be replenished to make the pH of the developer mother solution equivalent to that of the mother solution at the start of processing. In cases where the processing amount per day is minimal, it approaches this value.

With regard to the replenishing amount of the second developer replenishing solution, the minimum amount thereof is calculated from the analytical value obtained from the developer mother running-solution and as long as it is replenished in an amount more than the minimum amount, the replenishing amount is not specifically limited, but appropriately set according to the kind of silver halide photographic material and the type of an automatic processor. Effects of this invention are marked at a low processing amount. Specifically, the processing amount is preferably 1 to 80 $m^2$/day, and more preferably 5 to 30 $m^2$/day.

There are optionally employed solubilization aids such as polyethylene glycols, esters thereof, alkanolamine, etc.; sensitizers such as nonionic surface active agents containing a polyoxyethylene, quarternary ammonium compounds; etc.; surface active agents, antifoaming agents, anti-foggants such as halide compounds such as potassium bromide, sodium bromide,etc.;nitrobenzindazole, nitrobenzimidazole, benztriazole, benzthiazole, tetrazole compounds, thiazole compounds, etc.; chelating agents such as ethylenediaminetetraacetic acid or alkali salts thereof, nitrilotriacetic acid, polyphosphonic acids, etc.; development accelerators such as those compounds disclosed in the U.S. Pat. No. 2,304,025, JP-B 47-45541(hereinafter, the term, JP-B means published Japanese Patent); hardening agents Marx such as glutaraldehyde or metasulfite additives thereof, etc.; antifoaming agents, etc. The pH of the developing solution is preferably adjusted not less than 7.5 and less than 10.5. More preferably the pH is adjusted not less than 8.5 and less than 10.4.

As a fixing solution, any one which are popularly known in the art can be used. The fixing solution is an aqueous solution containing a fixing agent and other additives, and the pH of the fixing solution is usually between 3.8 and 5.8. As the fixing agent, for example, thiocyanates such as sodium thiosulfate, potassium thiosulfate, ammonium thiosulfate, sodium thiocyanate, potassium thiocyanate, ammonium thiocyanate and other organic sulfur compounds which are capable of producing a stable silver complex salts and are known in the art as a fixing agent can be used.

Into the fixing solution, a compound which functions as a hardening agent, including, for example, water-soluble aluminum salts such as aluminum chloride, aluminum sulfate, potassium alum, aldehyde compounds (such as glutaraldehyde or its sulfite adduct, etc.) may be added.

The fixing solution may contain, if necessary, preservatives such as sulfites or metasulfites; pH buffers such as acetic acid, citric acid, etc.; pH adjuster such as sulfuric acid, or chelating agents capable of softening hard water, etc. It is preferable that the concentration of ammonium ion in the fixing solution is 0.1 mol or less per liter of the fixing solution. Particularly preferable concentration of the ammonium ion in the fixing solution is between 0 and 0.5 mol per liter of fixing solution. As the fixing agent, sodium thiosulfate may be used instead of ammonium thiosulfate. They can also be used in combination. It is preferable that concentration of acetate ion is less than 0.33/liter. There may be applicable any compounds capable of releasing an acetate ion in the fixing solution. Acetic acid or a lithium, potassium, sodium or ammonium salt thereof are preferable. Particularly preferable are sodium salt and anmmonium salt. The concentration of the acetate ion is preferably 0.22 mol or less, and more preferably, 0.13 mol or less per liter of the fixing solution.

Under this condition generation of acetic acid gas can be highly restrained. Most advantageously, the fixing solution does not substantially contain any acetate ion at all. The fixing agent contains a salt of citric acid, tartaric acid, malic acid, succinic acid or an optical isomer thereof. As the salt of the citric acid, tartaric acid, malic acid or succinic acid, lithium salt, potassium salt, sodium salt, ammonium salt, etc. can be mentioned. Further, lithium hydrogen salt, potassium hydrogen salt, sodium hydrogen salt, or ammonium hydrogen salt of the tartaric acid; ammonium potassium tartarate; or-sodium potassium tartarate, etc. may also be used. Among these, are preferable citric acid, isocitric acid, malic acid and succinic acid and the salts thereof; and the most preferable compound id malic acid or salts thereof.

One feature of the processing method according to the invention, in which photographic materials are continuously processed using an automatic processor concerns that the first fixer replenishing solution having a fixing agent content less than that of the fixer mother solution used at the start of processing is replenished within the predetermined amount to be replenished per prescribed unit time, and in cases when the amount of the first fixer replenishing solution replenished has gone up to over the predetermined amount within the prescribed unit time or in cases when the amount of the photographic material processed has exceeded the predetermined amount of the photographic material to be processed per a scribed unit time, the second fixer replenishing solution having a fixing agent content more than the first fixer replenishing solution is replenished after that. The content of a fixing agent in the fixer mother solution at the start of processing is preferably 0.8 to 1.2 mol/l, the content of a fixing agent in the first fixer replenishing solution is preferably 0.6 to 0.8 mol/l, and the content of a fixing agent in the second fixer replenishing solution is preferably 0.8 to 1.4 mol/l.

Herein, the fixer mother solution is referred to as a fixer working solution in the fixing tank of an automatic processor, i.e., a fixer tank solution. Accordingly, the fixer mother solution used at the start of processing is referred to as a fixing solution in the fixing tank at the time of starting running-process. The first fixer replenishing solution, which has a fixing agent content less than that of the fixer mother solution is a fixer solution replenished while running process., The second fixer replenishing solution, which has a fixing agent less than the first fixer replenishing solution and preferably has a fixing agent content substantially equivalent to that of the fixer mother solution, is also a developer solution replenished while running process. Herein, the expression, fixing agent content substantially equivalent to that of the developer mother means that the fixing agent content is preferably within 98 to 102% of that of the fixer mother solution.

Photographic materials used in the invention is preferably subjected to washing with washing water containing a cleaning agent including an oxidant or fungicide. Examples of oxidants include metal or non-metal oxides, oxygen acids or their salts, peroxides, and organic acids. From the point of view of the discharge to a drain line are preferred oxygen acids such as sulfuric acid, nitrous acid, nitric acid or hypochlorous acid, and peroxides such as hydrogen peroxide or Fenton's acid. Hydrogen peroxide is. specifically preferred. From the point of view of physical distribution, it is preferred to supply the oxidants in the form of a concentrated solution or solid composition. The form of a concentrated solution is specifically preferred and its oxidant content is preferably 0.1 to 10 mol/l, and more preferably 0.5 to 2.0 mol/l. A concentrated solution or solid composition containing an oxidant is mixed with washing water and then supplied. The concentrated solution or solid composition may be mixed immediately before being introduced into a washing bath or may be mixed directly with washing water in a washing bath. With regard to the timing of replenishing the concentrated solution or solid composition containing an oxidant or water may be a constant replenishment per unit time or replenishment in which the processing amount of photographic materials is detected and replenishing is made in accordance with the processing amount. The addition amount of an oxidant to a washing bath is preferably 0.5 to 10 mol, and more preferably 0.5 to 3 mol equivalent with respect to thiosulfate carried-in by the photographic material.

It is a preferred embodiment to allow a preservative or fungicide to be concurrently present with an oxidant. Fungicides usable in the invention may be any one having no adverse effect on photographic performance. Examples of various bactericides and fungicides include thiazolylbenzimidazole type compounds, isothiazolone type compounds, chlorophenol type compounds, brdmophenol type compounds, thicyanic acid or isothiocyanic acid type compounds, acid azide type compounds, diazine or tiazine type compounds, thiourea type compounds, alkylguanidine compounds, quaternary ammonium salts, organic tin or organic zinc compounds, cyclohexylphenol compounds, imidazole or benzimidazole type compounds, sulfamide type compounds, active halogen type compounds such as sodium chloroisocyanurate, chelating agents, sulfite compounds, antibiotic substances such as penicillin. Further, there are usable compounds described in L. E. West, "Water Quality Criteria" Phot. Sci. and Eng., vol. 9 No. 6 (1965); bactericides described in JP-A 57-8542, 58-105145, 59126533, 55-111942 and 57-157244; and compounds described in H. Hamaguchi "Chemistry of Bactericide and fungicide" (published by Sankyo-shuppan, 1982) and "Antifungal and Antimold Technique Handbook" edited by Nihon Bokin-bobai Gakkai (published by Gihodo, 1986). In cases where the fungicide is supplied to washing water, the content thereof is preferably 0.01 to 50 g/l, and more preferably 0.05 to 20 g/l. In cases where being contained in a cleaning agent, the content is 0.1 to 50 g/l, and more preferably 1 to 20 g/l, with respect to the cleaning agent.

Examples of preservatives usable in the invention further include phosphoric acid, barbituric acid, urea, acetoanilide, oxyquinoline, salicylic acid, quinolinic acid, and their derivatives and salts. Of these, salicylic acid and its derivatives are preferred.

Chelating agents usable in the invention preferably are those which exhibit a chelate stability constant with a calcium ion of 0.8 to 5.0. The chelate stability constant with a calcium ion is the logarithm of a formation constant of one chelating agent molecule with one calcium ion, which is measured under the condition at a temperature of 20° C. and an ionic strength of 0.2. Examples thereof include organic acids such as maleic acid, glycolic acid, gluconic acid, glucoheptanoic acid, tartaric acid, citric acid, succinic acid, salicylic acid, ascorbic acid and erythorbic acid; aminopolycarboxylic acids such as glycine, ethylenediaminetetraacetic acid, diethylenetriaminepentaacetic acid and nitrilitriacetic acid, and their derivatives and salts. Organic acids are preferably gluconic acid and citric acid, and preferred aminopolycarboxylic acids are ethylenediaminetetraacetic acid and diethylenetriaminopentaacetic acid. These compound are used preferably in an amount of 0.005 to 0.2 mol, and more preferably 0.005 to 0.1 mol per lit of washing water. Specifically, in cases when the washing time id less than 20 sec., effects of the invention is marked and in the case of less than 12 sec., effects of the invention more marked.

In the invention, there can be employed developer or fixer replenishing solution which is prepared from a solid processing (i.e., developer or fixer) composition. The solid processing composition is in the form of powder, a tablet or granule, which are optionally subjected to a moisture-proofing treatment. A processing composition in the form of a paste or slurry is a semi-liquid form and inferior in storage stability. Those which are accompanied with danger in transportation and is subject to limitation are not included in the solid processing composition used in the invention. Herein, the powder refers to an aggregate of microcrystalline particles, the granules refers to granular material obtained by subjecting the powder to a granulating treatment, having a grain size of 50 to 500 μm, and the tablet refers to one obtained by subjecting the powder to granules to compression treatment to make a given form. Of solid processing compositions described above, the composition in a tablet form is preferably used in terms of the accuracy of replenishment and simplicity in handling.

The temperature in developing, fixing, and washing or stabilizing is preferably between 10 and 45° C., and the temperature of each step may be separately adjusted.

In light of a demand for shortening the overall processing time, it is preferable that the overall processing time (Dry-to-Dry) from the time when the front end of a film is put into the automatic processing machine to the time when it comes out of the drying zone is between 10 to 50 seconds. The overall processing time is referred to as a period of time including all processing steps necessary for processing a black-and-white photographic light sensitive material, such as developing, fixing, bleaching, washing, stabilizing and drying, alternatively, Dry to Dry time. In the case when the overall processing time is 10 seconds or less, satisfied photographic performance cannot be achieved due to desensitization or contrast-decreasing. The overall processing time is more preferably 15 to 44 seconds. To stably process large amounts such as 10 $m^2$ or more of the photographic material, a developing time is preferably 2 to 18 seconds.

In the present invention, a heat conductive member at 60° C. or more (e.g., a heat roller heated at 60 to 130° C.) or a radiation body at 150° C. or more (by directly applying electricity to a tungsten, carbon, Nicrome, a mixture of zirconium oxide, yttrium oxide or thorium oxide to heat and emit radiation, or by conducting thermal energy from a resistance pyrogeneous substance to a radiation emissive substance such as copper, stainless, nickel and various types of ceramics to generate heat or infrared radiation rays) can preferably be used to construct the heating zone.

In the present invention, there are preferably applicable a method or an automatic processor with mechanism, as described below.

(1) Deodorizing device: JP-A 64-37560, pp. 544(2), left upper col. to pp. 545(3), left upper col.

(2) Waste liquor-treatment method: JP-A 2-64638, pp. 388 (2), left lower col. to pp. 391 (5) left lower col.

(3) Rinsing bath between a developing bath and fixing bath: JP-A 4-313749, pp. (18) [005]] to (21) [0065].

(4) Water-replenishing method: JP-A 1-281446, pp. 250 (2) left lower col. to right lower col.

(5) Method for controlling drying air of a processor by detecting outdoor temperature and humidity: JP-A 1-315745, pp496 (2) right lower col. to pp.501(7) right lower col. ;JP-A 2-108051, pp. 588 (2), left col. to 589 (3) left lower col.

(6) Method for silver recovery from fixer effluent: JP-A 6-27623 pp. (4) [001]∛ to (7) [007]].

The processing system of silver halide photographic materials used in the invention comprises an apparatus for processing silver halide photographic materials, and a developer solution, fixer solution and washing water or a stabilizer solution. FIG. 1 illustrates one embodiment of the processing system and the processing apparatus. However, the embodiment of this invention is not limited to this. The apparatus 1 for processing silver halide photographic materials comprises a developing section 2 to develop an exposed photographic material with a developing solution 3, a fixing section 4 to fix the developed photographic material with a fixer solution 5, and a washing or stabilizing section 6 to wash with water 7 or to stabilize with a stabilizer solution 7 the fixed photographic material; the apparatus further comprises a developer replenishing section 8 to replenish a first developer replenishing solution exhibiting activity lower than that of a developer mother solution used at the start of processing, to the developing section, a memory section 9 to memorize a predetermined first amount to be replenished with the first developer replenishing solution in terms of volume per prescribed unit time or a predetermined amount of the photographic material to be processed per prescribed unit time, and a detecting section 10*a*, 10*b* to detect the amount of the first developer replenishing solution replenished per prescribed unit time or an amount of the photographic material processed per prescribed unit time.

Further, when the detecting section 10*a*, 10*b* detects that the amount of the first developer replenishing solution replenished exceeds the predetermined first amount memorized in the memory section 9 within the prescribed unit time, or when the amount of the photographic material processed exceeds the predetermined amount memorized in the memory section within the prescribed unit time, a second developer replenishing solution exhibiting higher activity than the first developer replenishing solution is replenished to the developing section. Furthermore, the developer solution contains the compound represented by formula (2), as a developing agent.

The developing section 2 is filled with a developer solution 3, and preferably a developing tank 2, in which a silver halide photographic material is immersed to be developed. The fixing section 4 is filled with a fixer solution 5, and preferably a fixing tank 4, in which a silver halide photographic material is immersed to be fixed. The washing section 6 is filled with washing water 7, and preferably a washing tank 6, in which a silver halide photographic material is immersed to be washed. The stabilizing section 6 is filled with a stabilizer solution 7, and preferably a stabilizing tank 6 in which a silver halide photographic material is immersed to be stabilized. Further, there is preferably provided with a drying section 17.

Examples of the memory section 9 include a memory, various types of ROMs, various types of RAMs and various kinds of recording medium (such as CD, floppy disk and DVD). The unit time is preferably prescribed to be one day, but it may also be 1 hr., ten hrs, etc. Various types of sensors can be employed as the detecting section 10*a*, 10*b*, including a sensor 10*b* capable of detecting the replenishing amount or replenishing rate of the replenishing solution and a sensor 10*a* capable of detecting the processing amount of silver halide photographic materials by an optical or physical means.

The developer replenishing section 8 includes various embodiments thereof. In one embodiment, for example., the developer replenishing section is a first storage section 11 to stock the first developer replenishing solution and a second storage section 12 to stock the second developer replenishing solution. The developer replenishing solution is usually supplied from the first storage section 11; when the detecting section 10*a*, 10*b* detects that the amount of the first developer replenishing solution having been replenished exceeds the predetermined first amount memorized in the memory section 9 within the prescribed unit time, or when the amount of the photographic material processed exceeds the predetermined amount memorized in the memory section 9 within the prescribed unit time, replenishment may be switched from the second storage section 12. In another embodiment, the developer replenishing section 8 comprises a replenisher supplying section 11 and a replenishing-water supplying section 12, and less replenisher solution and more replenishing water are usually supplied; when the detecting section 10*a*, 10*b* detects that the amount of the first developer replenishing solution replenished exceeds the predetermined first amount memorized in the memory section 9 within the prescribed unit time or when the amount of the photographic material processed exceeds the predetermined amount memorized in the memory section 9 within the prescribed unit time, then the replenisher solution is increased and the replenisher water is decreased. Control of the foregoing actions may be conducted by means of CPU or LSI, as a control section 13. Furthermore, there is preferably provided with a fixer replenishing section 14. The fixer replenishing section 14 preferably comprises a first fixer replenishing section 15 and a second fixer replenishing solution 16, or a fixer replenishing section 15 and water replenishing section 16.

EXAMPLES

Embodiments of the present invention will be explained based on examples, but the present invention is not limited to these.

Example 1

Preparation of Silver Halide Emulsion A

To solution A were added an aqueous silver nitrate solution (B) and an aqueous halide solution comprised of NaCl and KBr (C) by the double jet addition at a constant flow rate for a period of 30 min. at a pH of 3.0 and a temperature of 40° C. to obtain cubic silver bromochloride grains containing 70 mol % chloride and having an average size of 0.2 $\mu$m. During addition, the silver potential (EAg) was 160 mV at the time of starting the addition and 100 mV at the time of completion the addition. Thereafter, soluble salts were removed by ultrafiltration and then, adding gelatin of 15 g per mol of silver and adjusting the pH to 5.7, the emulsion was redispersed over a period of 30 min. After dispersion, $4\times10^{-4}$ mol/mol Ag of chloramines T was added thereto. The resulting emulsion exhibited a silver potential of 190 mV (at 40° C.).

| | |
|---|---|
| Solution A | |
| Ossein gelatin | 25 g |
| Nitric acid (5%) | 6.5 ml |
| Deionized water | 700 ml |
| $Na[RhCl_5(H_2O)]$ | 0.02 mg |
| Solution B | |
| Silver nitrate | 170 g |
| Nitric acid (5%) | 4.5 ml |
| Deionized water | 200 ml |
| Solution C | |
| NaCl | 47.5 g |
| KBr | 51.3 g |
| Ossein gelatin | 6 g |
| $Na_{3\,[IrCl_6]}$ | 0.15 mg |
| Deionized water | 200 ml |

To the resulting emulsion were added $1.5\times10^{-3}$ mol/mol Ag of 4-hydroxy-6-methyl-1,3,3a,7-tetrazaindene and $8.5\times10^{-4}$ mol/mol Ag of potassium bromide, then, the pH and EAg were adjusted to 5.6 and 123 mV, respectively. Subsequently, adding $2\times10^{-5}$ mol/mol Ag of finely granular sublimed sulfur and $1.5\times10^{-5}$ mol/mol Ag of chloroauric acid, chemical ripening was carried out at a temperature of 50° C. for a period of 80 min. After completion of chemical ripening were added $2\times10^{-3}$ mol/mol Ag of 4-hydroxy-6-methyl-1,3,3a,7-tetrazaindene, $3\times10^{-4}$ mol/mol Ag of 1-phenyl- 5-mercaptotetrazole and $1.5\times10^{-3}$ mol/mol-Ag of potassium iodide. After lowering the temperature to 40° C., sensitizing dyes S-1 and S-2, $4\times10^{-4}$ mol/mol Ag of each were added thereto to obtain silver halide emulsion A.

S-2

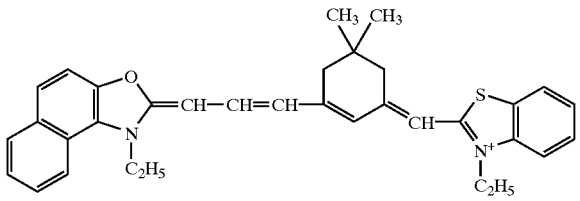

S-1

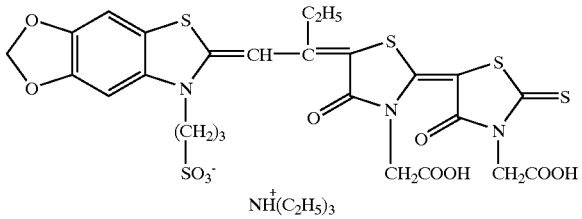

Using the thus obtained emulsion, the following 1st, 2nd and 3rd layers were simultaneously coated on one side of a subbed support in this order from the support so that the coating weights per $m^2$ were as below, and subjected to setting with cooling. Thereafter, the following backing layer was coated on the other side of the support, having an antistatic layer and set at −1° C., then, both sides were simultaneously dried-to obtain photographic material 1.

Support and Sublayer

After subjecting both sides of a biaxially stretched polyethylene terephthalate support (having 100 $\mu$m thick) to corona discharge of 30 W/($m^2$.min), the following sublayer composition was coated on both sides of the support and dried at 100° C. for 1 min.

| | |
|---|---|
| 2-Hydroxyethyl methacrylate (25)-butyl acrylate (30)-t-butyl acrylate (25)-styrene (20) copolymer (number: weight percentage) | 0.5 g/$m^2$ |
| Surfactant A | 3.6 mg/$m^2$ |
| hexamethylene-1,6-bis (ethyleneurea) | 10 mg/$m^2$ |

Antistatic Layer

After subjecting subbed polyethylene terephthalate support to corona discharge of 10 W/($m^2$.min), the following antistatic layer composition was coated on one side of the support at a coating speed of 70 m/min using roll fit coating pan and air-knife, dried at 90° C. for 2 min., and further subjected to a thermal treatment at 140° C. for 90 sec.

| | |
|---|---|
| Aqueous-soluble conductive polymer B | 0.6 g/$m^2$ |
| Hydrophobic polymer particle C | 0.4 g/$m^2$ |
| Polyethylene oxide compound (Mw: 600) | 0.1 g/$m^2$ |
| Hardener E | 0.2 g/$m^2$ |
| 1st Layer | |

-continued

| | |
|---|---|
| Gelatin | 0.30 g |
| 1-Phenyl-4-methyl-4-hydroxymethyl-3-pyrazolidone | 0.005 g |
| Sodium isoamyl-n-decysulfosuccinate | 0.005 g |
| Sodium dodecylbenzenesukfonate | 0.02 g |
| 2-Methylhydroquinone | 0.10 g |
| AM | 0.05 g |
| Poly(styrenesufonic acid) (Mw: 500,000) | 0.02 g |

2nd Layer (Emulsion layer)

| | |
|---|---|
| Gelatin | 1.0 g |
| Silver halide emulsion A (in silver amount) | 3.3 g |
| Hydrazine derivative (1-3) | 0.015 g |
| Hydrazine derivatives (1-5) | 0.020 g |
| AM | 0.15 g |
| 5-nitroindazole | 0.01 g |
| 2-mercaptohypoxanthine | 0.02 g |
| Suspension mixture of 75 wt % colloidal silica, 12.5 wt % vinyl acetate and 12.5 wt % vinyl pivalynate | 1.4 g |
| Polymer latex L1 (particle size of 0.10 μm) | 0.5 g |
| Dextran (Av. Mw of 40,000) | 0.1 g |
| Surfactant (SU-1) | 0.09 g |
| 4-Mercapto-3,5,6-fluorophthalic acid | 0.05 g |
| Poly(sodium styrenesulfonate) (Av. Mw: 500,000) | 0.015 g |

The pH of coating solution was 5.2.

3rd Layer (protective layer)

| | |
|---|---|
| Gelatin | 0.50 g |
| Dextran (Av. Mw of 40,000) | 0.2 g |
| Colloidal silica | 0.10 g |
| Surfactant (SU-2) | 0.02 g |
| Sodium hexylsulfosuccinate | 0.010 g |
| Fungicide Z | 0.005 g |
| Hardener (1) | 0.07 g |
| Polymethyl methacrylate latex (size: 3 μm) | 0.01 g |

Backing Layer

| | |
|---|---|
| Gelatin | 2.0 g |
| Dye (F-1) | 0.05 g |
| Dye (F-2) | 0.09 g |
| Sodium hexylsulfosuccinate | 0.020 g |
| Suspension mixture of 75 wt % colloidal silica, 12.5 wt % vinyl acetate and 12.5 wt % vinyl pivalynate | 0.7 g |
| Poly(sodium styrenesulfonate) | 0.010 g |
| Matting agent, monodisperse polymethyl methacrylate | 0.045 g |
| Hardener (1) | 0.05 g |
| Hardener (2) | 0.07 g |

L1

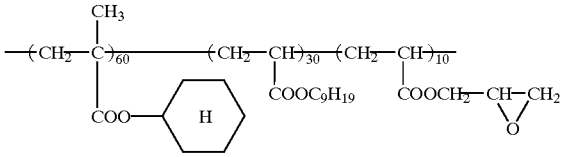

SU-1

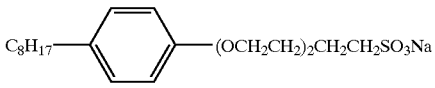

SU-2

$C_7F_{15}CH_2(OCH_2CH_2)_{13}OH$

AM

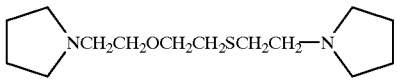

Hardener (1)

$(CH_2{=}CHSO_2CH_2CONHCH_2)_2{-}$

Hardener (2)

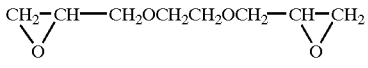

Fungicide Z

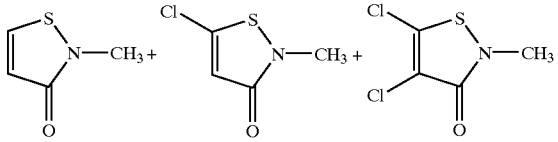

Aqueous-soluble conductive polymer B

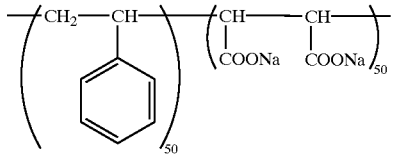

Hydrophobic polymer particle C

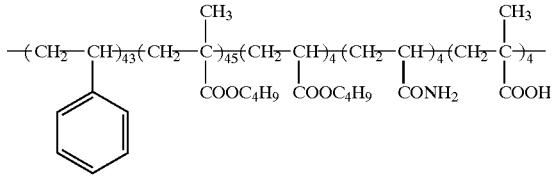

Hardener E

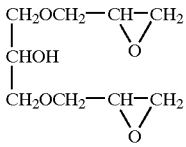

Surfactant A

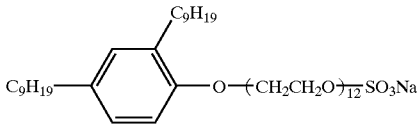

F-1

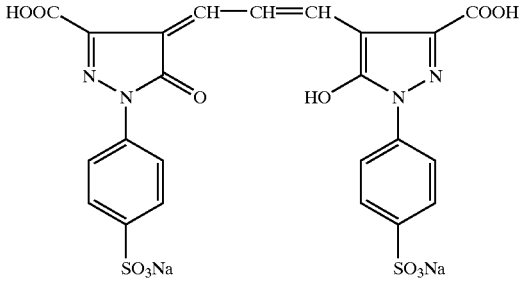

F-2

-continued

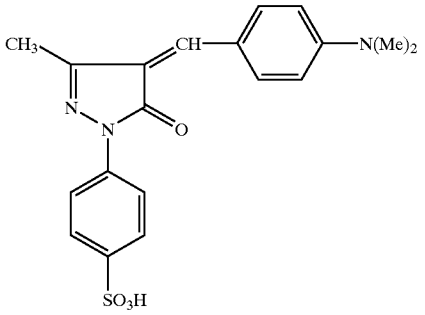

The thus obtained photographic material 1 was exposed using FTR-3050 (available from DAINIPPON SCREEN Co. Ltd.), then, developed, fixed, washed and dried by automatic processor LD-M1060 (available from DAINIPPON SCREEN Co. Ltd.) according to the steps described below. The developer was used as shown in Tables 1 and 2 with respect to formula and activity thereof, respectively. Fixer type 881 (available from Konica Corp.) was used.

Processing Condition

| Step | Temperature | Time |
|---|---|---|
| Developing | 38° C. | 15 sec. |
| Fixing | 38° C. | 15 sec. |
| Washing | 25° C. | 15 sec. |
| Drying | 50° C. | 15 sec. |

TABLE 1

| | Starting Developer A | Replenisher B | Replenisher C | Replenisher D | Replenisher E |
|---|---|---|---|---|---|
| Diethylenetriaminepentaacetic acid | 3 g | 3 g | 3 g | 3 g | 3 g |
| Sodium sulfite | 30 g | 30 g | 30 g | 30 g | 30 g |
| Potassium carbonate | 50 g | 50 g | 50 g | 50 g | 50 g |
| Potassium hydrogencarbonate | 16 g | 16 g | 16 g | 16 g | 16 g |
| Dimezone S | 1.5 g | 1.5 g | 1.5 g | 1.5 g | 1.5 g |
| Sodium erythorbate | 55 g | 55 g | 55 g | 55 g | 40 g |
| 1-pPhenyl-5-mercaptotetrazole | 0.03 g | 0.03 g | 0.03 g | 0.03 g | 0.03 g |
| Potassium bromide | 5 g | 5 g | 5 g | 5 g | 5 g |
| Benzotriazole | 0.30 g | 0.30 g | 0.30 g | 0.40 g | 0.30 g |
| Diethylene glycol | 10 g | 10 g | 10 g | 10 g | 10 g |
| 8-Mercaptoadenine | 0.08 g | 0.08 g | 0.08 g | 0.08 g | 0.08 g |
| Water to make | 1 L | 1.2 L | 1 L | 1 L | 1 L |

TABLE 1-continued

| | Starting Developer A | Replenisher B | Replenisher C | Replenisher D | Replenisher E |
|---|---|---|---|---|---|
| pH (adjusted with KOH) | 10.0 | 10.0 | 9.9 | 10.0 | 10.0 |
| | | *1 | *2 | *3 | *4 |

*1: Water was added in excess.
*2: Lower pH than Developer A
*3: Benzotriazole was increased.
*4: Erythorbate was decreased.

TABLE 2

| Starting Developer A | Replenisher B | Replenisher C | Replenisher D | Replenisher E |
|---|---|---|---|---|
| 100 | 85 | 85 | 85 | 85 |

The activity, as shown in Table 2 was represented by a relative value of reciprocal of exposure necessary to give a density of 1.5, based on that of developer A being 100, when the photographic material was exposed and processed with each of developers A to E in such a manner as described above.

Developer A was put into the processor (LD-M1060) and 30 sheets of photographic material of a size of 610×508 mm and a half area of which was exposed was processed by the processor without replenishing any developer in a day. Next morning after being allowed to stand in a night, the replenishing amount necessary to give the activity (based on sensitivity) equivalent to that of the starting developer A in the preceding day was experimentally determined for replenishment of each of developers B to E. As a result, it was proved that the developer-replenishing amount to be necessary was 1.2 lit., so that replenishment was conducted at a rate of 40 ml per sheet.

Then, processing was run for 20 days, in which 30 sheets of photographic material per day were processed at a developer-replenishing rate of 1.2 lit. per day. Sensitivity (S) was represented by a relative value, based on the sensitivity obtained by a fresh solution of developer A being 100. Gradation (γ) was determined from the slope of a line connecting points giving densities of 1 and 3 on a characteristic curve. After completion of running process, an unexposed photographic material sheet was processed and visually evaluated with respect to stains caused by silver sludge, based on the following criteria:

Rank 1: Silver sludge was overall adhered,

Rank 2: Intermediate between ranks 1 and 3,

Rank 3: Silver sludge adhered was observed, but acceptable levels in practical use Rank 4: Intermediate between ranks 3 and 4, and Rank 5: No stain observed.

For comparison, photographic material was processed at a replenishing rate of 60 ml and 120 ml per sheet (of a size of 610×508 mm). Results are shown in Table 3.

TABLE 3

| Expt. No. | Replenishing developer | Fresh Solution S | Fresh Solution γ | Running Solution S | Running Solution γ | Sludge |
|---|---|---|---|---|---|---|
| 1 | A | 100 | 12.1 | 74 | 10.1 | 1 |
| 2 | B | 100 | 12.1 | 99 | 12 | 4 |
| 3 | C | 100 | 12.1 | 100 | 12 | 4 |
| 4 | D | 100 | 12.1 | 100 | 12 | 5 |
| 5 | E | 100 | 12.1 | 101 | 12 | 5 |

As apparent from Table 3, the present invention was little in reduction of sensitivity and gradation and improved staining, leading to stable development performance.

Processing was run for 20 days similarly to above examples, provided that 30 sheets of a photographic material of 600×508 mm were processed, while replenishing a lower-active developers, and after the number of the photographic material exceeded 30 sheets, further 70 sheets per day were processed with replenishing developer A according the conditions shown in Table 4. Results thereof are shown in Table 5.

TABLE 4

| Expt. No. | 1 to 30 sheets | 31 to 100 sheets |
|---|---|---|
| 21 (Comp.) | Replenished at 40 ml C per sheet | Replenished at 40 ml C per sheet |
| 22 (Inv.) | Replenished at 40 ml C per sheet | Replenished at 40 ml A per sheet |
| 23 (Comp.) | Replenished at 40 ml E per sheet | Replenished at 40 ml E per sheet |
| 24 (Inv.) | Replenished at 40 ml E per sheet | Replenished at 40 ml A per sheet |

TABLE 5

| Expt. No. | Fresh Solution S | Fresh Solution γ | Running Solution S | Running Solution γ | Sludge | Remark: |
|---|---|---|---|---|---|---|
| 21 | 100 | 12.1 | 75 | 10.2 | 2 | Comp. |
| 22 | 100 | 12.1 | 100 | 12.1 | 5 | Inv. |
| 23 | 100 | 12.1 | 72 | 9.9 | 2 | Comp. |
| 24 | 100 | 12.1 | 101 | 12 | 5 | Inv. |

As is apparent from Table 5, processing according to the invention led to stable photographic performance without reduction ion in sensitivity and gradation when subjected to running process.

Example 2

Fixer solutions were prepared, as shown in Table 6.

TABLE 6

| | Starting Fixer A | Replenisher B | Replenisher C |
|---|---|---|---|
| Ammonium thiosulfate | 140 g | 140 g | 120 g |
| Sodium sulfite | 25 g | 25 g | 25 g |
| Gluconic acid | 5 g | 5 g | 5 g |
| tartaric acid | 3 g | 3 g | 3 g |
| Sodium acetate trihydrate | 38 g | 38 g | 38 g |

TABLE 6-continued

| | Starting Fixer A | Replenisher B | Replenisher C |
|---|---|---|---|
| Acetic acid (aqueous 90% solution) | 13.5 g | 13.5 g | 13.5 g |
| Aluminum sulfate octadecahydrate | 17 g | 17 g | 17 g |
| Isoelete P (available from Ensuiko Seito Co.) | 3 g | 3 g | 3 g |
| Water to make | 1 L | 1.2 L | 1 L |
| pH (adjusted with KOH) | 4.75 | 4.75 Diluted with water | 4.75 Fixing agent was decreased. |

Fixer A was put into the processor (LD-M1060) and 30 sheets of photographic material of a size of 610×508 mm and a half area of which was exposed was processed by the processor without replenishing any fixer in a day. Next morning after being allowed to stand in a night, the replenishing amount necessary to give clearness equivalent to that obtained at the start of processing in the preceding day was experimentally determined for replenishment of fixer B or C. As a result, it was proved that the fixer-replenishing amount to be necessary was 1.2 lit., so that replenishment was conducted at a rate of 40 ml per sheet.

Then, processing was run for 30 days, in which 30 sheets of photographic material per day were processed at a fixer-replenishing rate of 1.2 lit. per day. After completion of running process, an unexposed photographic material sheet was also processed and visually evaluated with respect to fixing clearness relating to unfixed, remaining silver halide, based on the following criteria:

Rank 1: Overall whity and poor fixing

Rank 2: Intermediate between ranks 1 and 3,

Rank 3: Slightly whity but acceptable levels in practical use,

Rank 4: Intermediate between 3 and 5,

Rank 5: superior fixing.

For comparison, a photographic material sheet of 610×508 mm was processed at a replenishing rate of 60 ml and 120 ml per sheet (Expt. No. 31); Results are shown in Table 7.

TABLE 7

| Expt. No. | Replenisher | Fixing clearness |
|---|---|---|
| 31 | Fixer A | 2 |
| 32 | Replenisher B | 5 |
| 33 | Replenisher C | 5 |

As can be seen from Table 7, processing according to the invention led to superior fixing clearness.

Processing was run for 20 days similarly to above examples, provided that 30 sheets of a photographic material of a size of 600×508 mm were processed, while replenishing fixer B or C, and after the number of the photographic material exceeded 30 sheets, further 70 sheets per day were processed with replenishing fixer A according the conditions shown in Table 8. Results thereof are shown in Table 9.

TABLE 8

| Expt. No | 1 to 30 sheets | 31 to 100 sheets |
|---|---|---|
| 41 (Comp.) | Replenished at 40 ml B per sheet | Replenished at 40 ml B per sheet |
| 42 (Inv.) | Replenished at 40 ml B per sheet | Replenished at 40 ml A per sheet |
| 43 (Comp.) | Replenished at 40 ml C per sheet | Replenished at 40 ml C per sheet |
| 44 (Inv.) | Replenished at 40 ml C per sheet | Replenished at 40 ml A per sheet |

TABLE 9

| Expt. No. | fixing clearness | Remark |
|---|---|---|
| 41 | 2 | Comp. |
| 42 | 5 | Inv. |
| 43 | 2 | Comp. |
| 44 | 5 | Inv. |

As can be seen from Table 9, processing according to the invention led to superior fixing clearness.

Disclosed embodiments can be varied by a skilled person without departing from the spirit and scope of the invention.

What is claimed is:

1. In a method for processing a silver halide light sensitive photographic material comprising the steps of:

(a) developing an exposed photographic material with a developer solution, (b) fixing the developed photographic material with a fixer solution, and (c) washing with water or stabilizing with a stabilizer solution the fixed photographic material, wherein the photographic material comprises a support and a silver halide emulsion layer, and herein in step (a), a first developer replenishing solution exhibiting activity lower than that of a developer mother solution used at the start of processing is replenished, a first amount to be replenished with the first developer replenishing solution is predetermined in terms of volume per prescribed unit time, so that in case that the replenished amount of the first developer replenishing solution exceeds the first amount within the prescribed unit time, a second developer replenishing solution exhibiting activity higher than that of the first developer replenishing solution is replenished, the improvement comprising with respect to sludge formation after many days in the above method and the developer solution comprises a compound represented by formula (2) as a developing agent in an amount of 0.1 to 1.0. mol/l, formula (2)

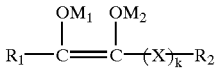

wherein $R_1$ and $R_2$ are each an alkyl group, an amine group, an alkoxy group, or an alkylthio group, provided that $R_1$ and $R_2$ may combine together with each other to form a ring; k is 0 or 1; when k is 1, X is —CO— or —CS—; and $M_1$ and $M_2$ are each a hydrogen atom or an alkali metal atom.

2. The method of claim 1, wherein the second developer replenishing solution exhibits activity substantially equivalent to that of the developer mother solution used at the start of developing.

3. The method of claim 1, wherein the photographic material further comprises a compound represented by the following formula (1):

formula (1)

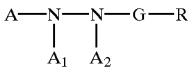

wherein A is an aryl group or a heterocyclic group containing an oxygen atom or a sulfur atom; G is —(CO)n—, sulfonyl group, sulfoxy group, —P(=O)$R_{22}$—, or iminomethylene group, in which n is an integer of 1 or 2 and $R_{22}$ is an alkyl group, an alkenyl group, an alkyny group, an aryl group, an alkoxy group, an alkenyloxy group, an alkynyloxy group, an aryloxy group or an amino group; $A_1$ and $A_2$ are both hydrogen atoms, or either of them is a hydrogen atom and the other is an alkylsulfonyl group or an acyl group; and R is a hydrogen atom or an alkyl group, an alkenyl group, an aryl group, an alkoxy group, an alkenyloxy group, an aryloxy group, a heterocyclic-oxy group, an amino group, a carbamoyl group or an oxycarbonyl group.

4. The method of claim 1, wherein in step (b), a first fixer replenishing solution having a fixing agent content less than that of a fixer mother solution used at the start of processing is replenished, a first amount to be replenished with the first fixer replenishing solution is predetermined in terms of volume per prescribed unit time, so that in case that the replenished amount of the first fixer replenishing solution exceeds the first amount within the prescribed unit time, a second fixer replenishing solution having a fixing agent content more than that of the first fixer replenishing solution is replenished thereafter.

5. The method of claim 1, wherein the second fixer replenishing solution has a fixing agent content substantially equivalent to that of the fixer mother solution used at the start of processing.

6. In the method of claim 1, the compound represented by formula (2) is ascorbic acid, erythorbic acid or their salts of sodium, potassium or lithium.

* * * * *